United States Patent [19]

McKinnon

[11] 4,334,651

[45] Jun. 15, 1982

[54] AUTOMATIC HYDRAULIC ROLL WINDER

[76] Inventor: Charles A. McKinnon, 60 Woodland Hills, Tuscaloosa, Ala. 35405

[21] Appl. No.: 161,378

[22] Filed: Jun. 20, 1980

[51] Int. Cl.[3] ..... B65H 19/20; B65H 17/02

[52] U.S. Cl. ..... 242/56 R; 242/67.2

[58] Field of Search ..... 242/56 R, 67.1 R, 67.2, 242/67.3 R, 56 B

[56] References Cited

U.S. PATENT DOCUMENTS

| | | | |
|---|---|---|---|
| 1,601,784 | 10/1926 | Wonders | 242/56 R |
| 2,449,234 | 9/1948 | Knoble | 242/56 R |
| 2,539,745 | 1/1951 | Keller | 242/56 R X |
| 2,839,256 | 6/1958 | Boyan | 242/56 R |
| 2,880,943 | 4/1959 | Stephens | 242/67.1 R |
| 3,167,268 | 1/1965 | Birch | 242/56 R |
| 3,414,207 | 12/1968 | Maynard | 242/56 R |
| 3,494,566 | 2/1970 | Powelczyk | 242/56 R |

*Primary Examiner*—Edward J. McCarthy

*Attorney, Agent, or Firm*—Robert C. Lucke

[57] ABSTRACT

This apparatus is an automatic winder of roofing material utilizing hydraulic power to operate pull rollers at increased speed; to operate a knife and anvil with greatly reduced shock and noise; to enable a high speed mandrel to be loaded and unloaded more accurately and more rapidly while minimizing misfeed occurences; to provide for automatic shutdown in case of malfunction, to isolate the sheet material from all but the pull rollers and the mandrel while the winding operation is in progress; and provide a sound reducing hydraulic reservoir within the frame of the machine to absorb shocks and noise. Accommodation for minimum flexing of the sheet material is provided.

This invention is directed to an automatic hydraulic roll winder, and more particularly, to an apparatus for automatically winding, measuring, cutting, and removing web materials using hydraulic power.

9 Claims, 16 Drawing Figures

AUTOMATIC HYDRAULIC ROLL WINDER

BACKGROUND OF THE INVENTION

When roofing material is manufactured, it is in the form of a continuous sheet made up of lengths spliced together. This sheet must be cut to predetermined lengths and rolled for commercial usage. These smaller rolls are formed on a mandrel and are prepared in various modes including manual control and, more recently, automatic electrical control as shown in U.S. Pat. No. 4,099,682 issued July 11, 1978, to Alfred L. Benuska. There are various difficulties associated with these prior machines for preparing roll material that this invention is designed to alleviate. Such difficulties are in the hardships in trouble shooting, in high levels of wear and difficulty in repairing, the loss of considerable sheet material inherent in the feed through type mandrel, difficulty in feeding this material into a winder, controlling the length of the finished product, controlling the tension of the web without constant adjustment, controlling the noise levels, providing faster operation, and the difficulty of running open faced gears faster than recommended, and operating such gears out of mesh. Further, difficulty in the control of adding product to the roll that is necessary because of the splice required to join the web from the end of one supply roll to the beginning of the next supply roll, the difficulties of using chain drives, inaccessibility of control panels to enable operators to perform multiple tasks; these and other difficulties in the prior art led to the improvements found in this invention.

Objects of this invention are to alleviate the various difficulties set forth above as well as further advantages set forth in the following specification.

SUMMARY OF THE INVENTION

Winding rolls of roofing material is accomplished by the utilization of hydraulic powered driving means to give precise velocities, tensions, positions and measurements while eliminating readily deteriorating mechanisms of the prior art. Engagement of the mandrel and the material to be rolled is facilitated; contact of the material with only the pull rollers and the mandrel during the rolling operation is provided; precise knife and anvil action occurs with acceleration throughout the cutting, a deceleration and a low velocity for the resetting without undue shock; an ejector trolley operates without binding forces; precise measurement of the roll lengths by an electronic counter in cooperation with a fixed precisely measured circumference of one of the pull rollers is made; consistently tensioned product rolls are produced; noise levels are diminished; contamination of mechanisms of the machine by contaminants inherent in the process is minimized; and a significant decrease in time of preparing a roll of material is accomplished. These and other features contribute to the departures from the prior art.

The foregoing and other objects, features, and advantages of the present invention will be apparent from the following description of the preferred embodiment of the invention as is illustrated in the accompanying drawings.

DESCRIPTION OF THE INVENTION

Figure 1:
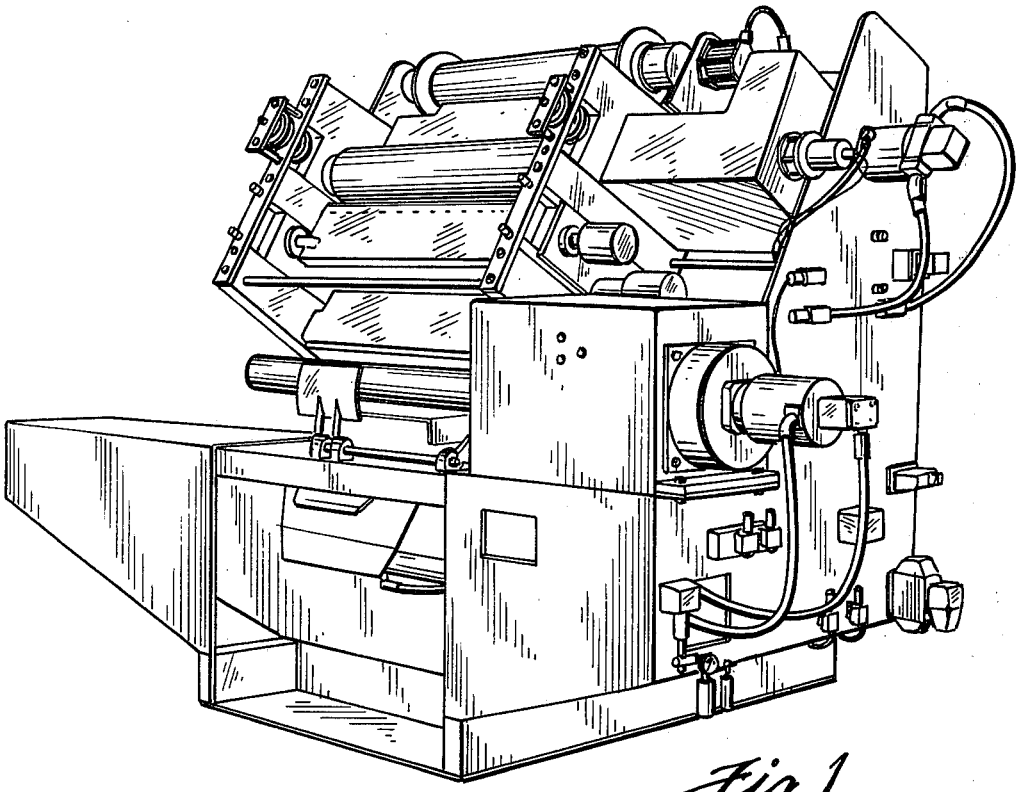
FIG. 1 is a perspective view of the complete winding machine.

The automatic hydraulic roll winder is a machine for the purpose of winding asphalt roofing products into rolls of predetermined lengths convenient for shipping, handling, and application on the roof. This winder, as shown in FIG. 1 and more clearly in FIG. 2, consists of a set of pull rollers 11 and 12 which pull the manufactured roofing product from the sheet source, usually supplied from large rolls mounted in an over head room, through a set of flanged edge guides 13 on roller 14 and meters it through a cutting apparatus made up of knife 15 and anvil roller 16 over a guide means 17 to a mandrel 18. An ejector trolley 19 removes the completed product roll 20 to free the mandrel to repeat the winding operation.

THE MANDREL

Figure 8:
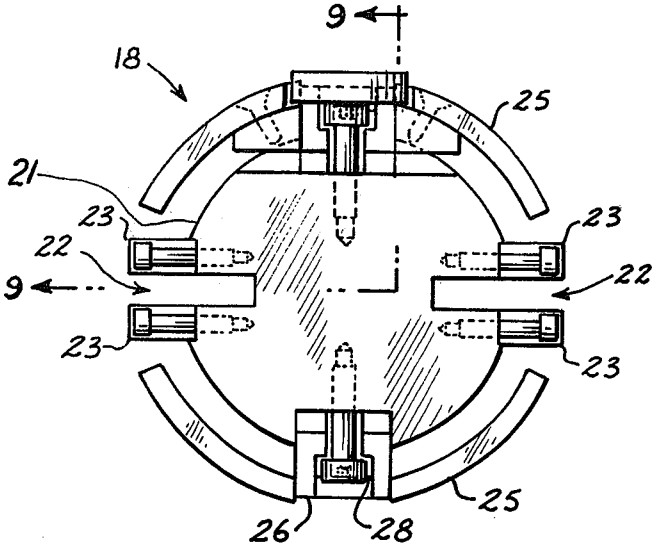
FIG. 8 shows an end of the mandrel.
Figure 9:
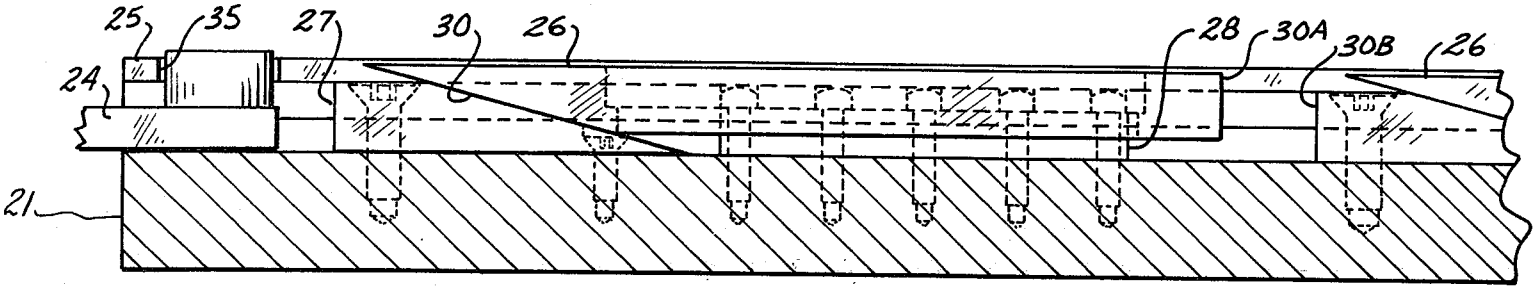
FIG. 9 shows shaft and connector details of a mandrel.

The mandrel 18, as shown in detail in FIGS. 8 and 9, is made up of a long shaft 21 upon which a minimum of machining has been performed in order to maintain maximum strength; thereby enabling elimination of outbound bearings therefor. The receiving slot 22 is machined into the shaft 21 and is lined with replaceable wearing strips 23 which receive the leading edge of the sheet 24. Collapsing plates 25 are provided that expand for the sheet 24 to be wound thereon into a product roll 20 and collapse for the ejection of the finished roll 20. The collapsing plates move in the direction of the movement of the ejection or roll 20 while simultaneously collapsing. This feature is provided to assist in relieving the problem of sticking rolls by allowing the collapsing plates to gain velocity with the ejecting roll 20 and then shake loose upon the arrival at the end of the travel of such plates 25.

The collapse and expansion of the mandrel 18 is accomplished by the interaction of aligned inclined surfaces of wedge structures 26 and 27. Wedges 27 are fixed on the shaft of the mandrel and the mating moving wedges 26 are mounted on the collapsing plates 25. That is, movable wedge elements 26 mounted within the collapsing plates 25 engage the inclined surfaces of fixed wedge elements 27 to expand until restrained by a plurality of T-shaped retaining devices 28 operatively connected to the shaft and the plate 25, such expansion being enabled by the pulling by a pair of connecting rods 34 anchored through an aperture means 35 on collapsing plates 25. For each wedge 26 there is a retaining device 28 associated therewith as well as a mating wedge 27 associated therewith. For collapsing, the plates 25 move such that wedges 26 and 27 slide on each other to permit the plates to move towards each other and to travel until the butt ends 30A of the movable wedges 26 engage the butt ends 30B of wedges 27. This engagement caused the shock effect that assures the removal of product roll 20.

MANDREL OPERATING STRUCTURE

Figure 5:
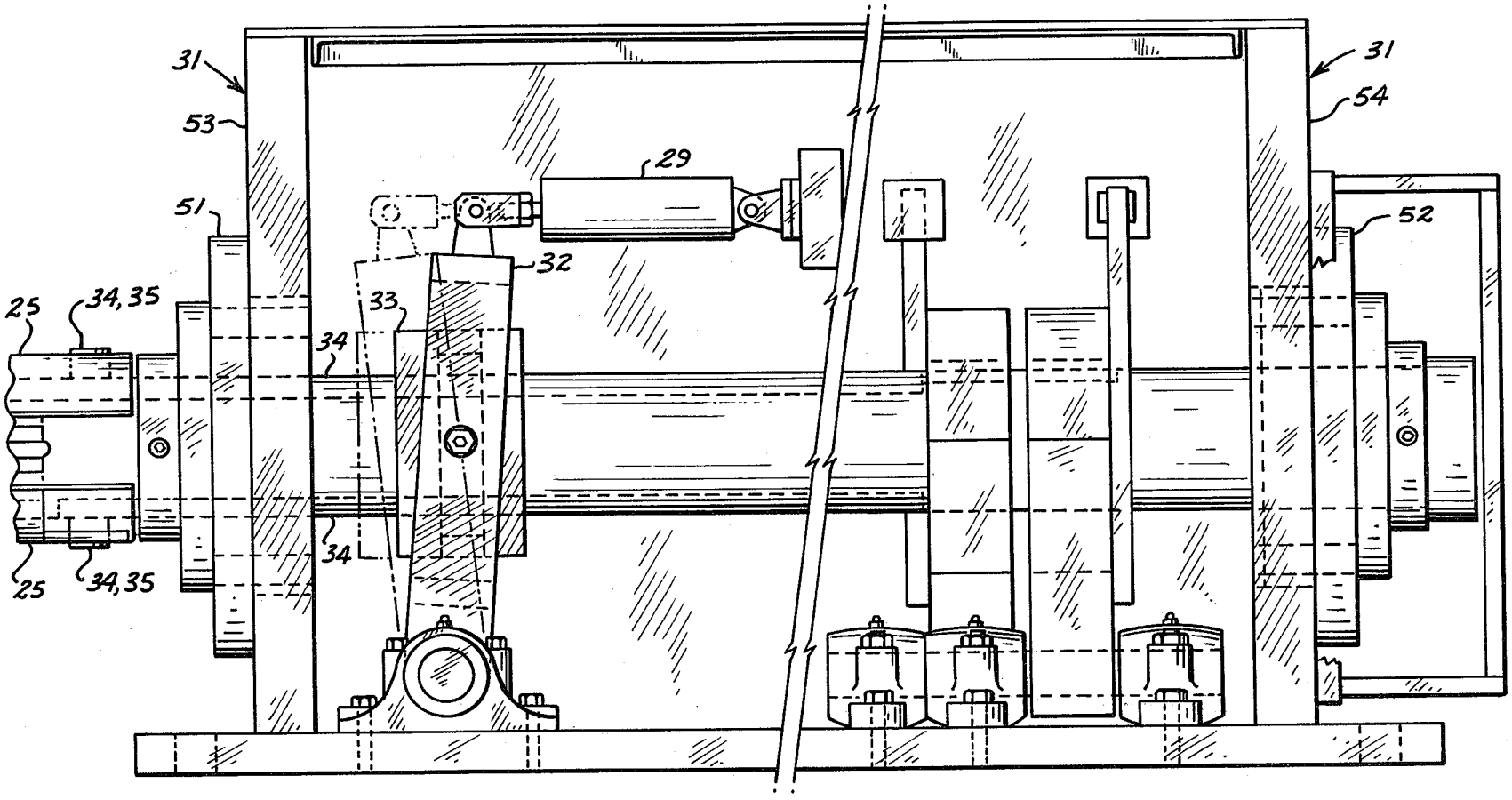
FIG. 5 is a front view of mandrel indexing structure.
Figure 6:
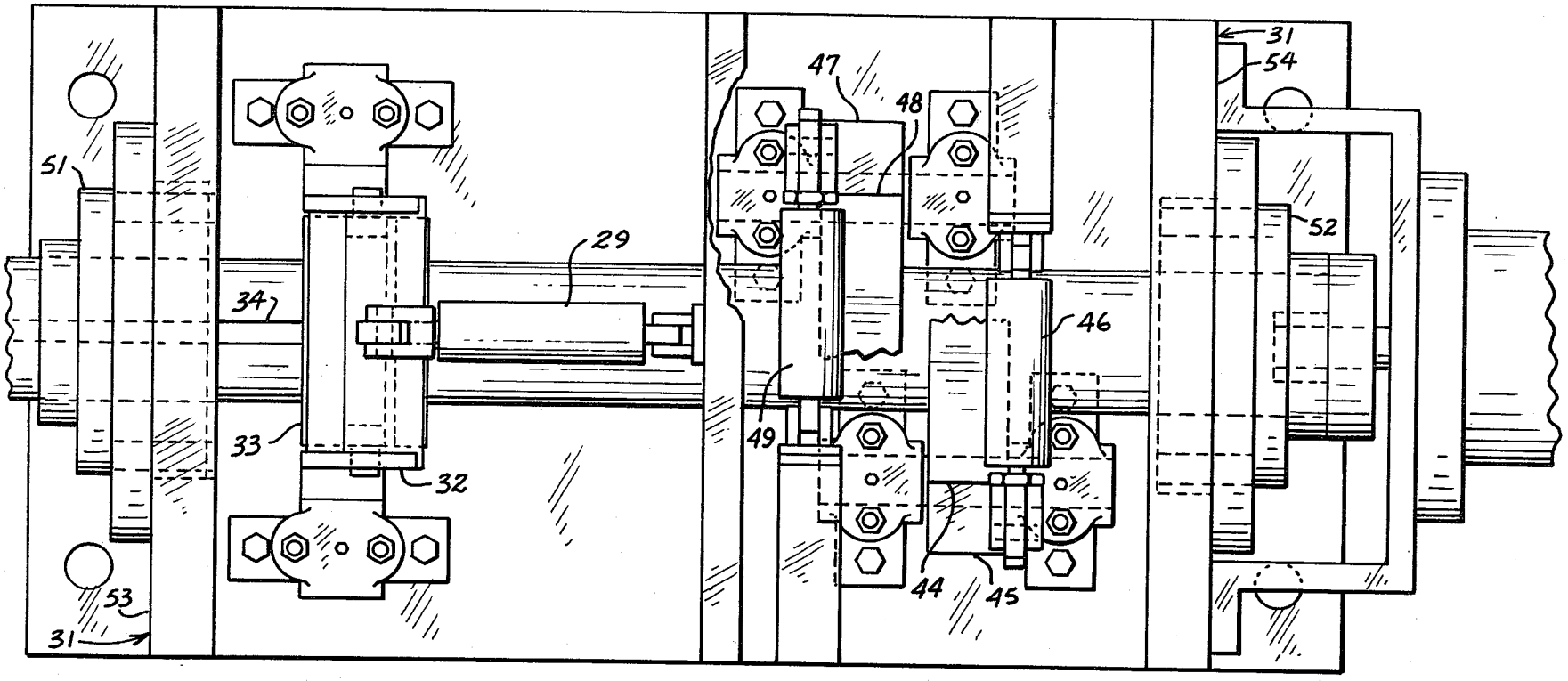
FIG. 6 is a view from above the mandrel indexing structure.
Figure 7:
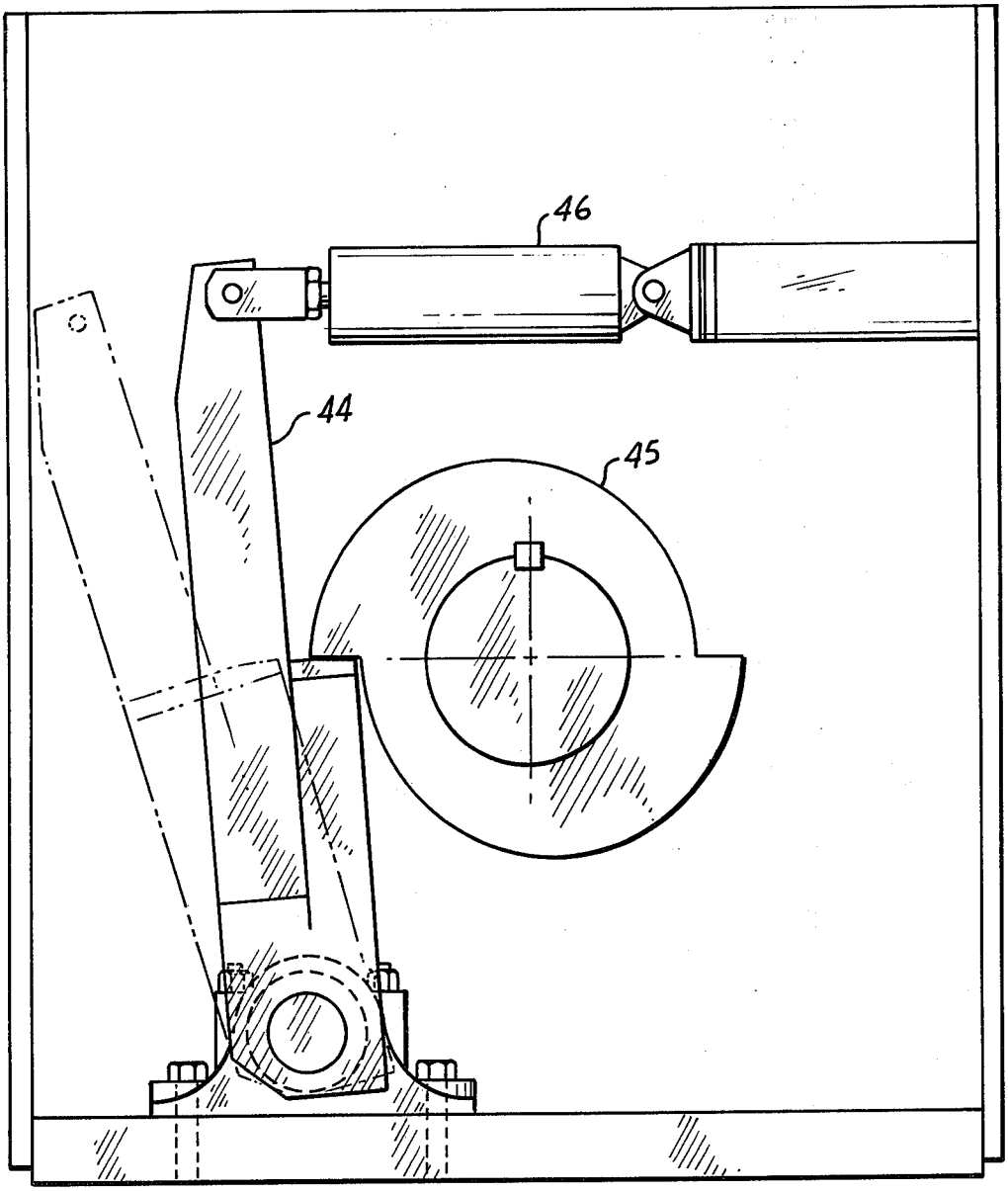
FIG. 7 shows the detail of the mandrel indexing structure.

In FIGS. 5 and 6 are shown the mandrel mounting means 31 which includes two tapered roller bearings 51 and 52, the centers of which are located on two parallel surfaces 53 and 54 on opposed ends of mounting means 31 and are aligned on those surfaces by pilot holes line bored through the two surfaces. The mandrel motor 55 is mounted on the motor mounting bracket 56 which is also machined parallel on both sides with a pilot hole concentric with the pilot holes for the mandrel support bearings 51 and 52. The motor is connected directly to the mandrel through a replaceable spline connection at the inward end of the mandrel.

A hydraulic cylinder 29 is mounted within the mandrel mounting means 31 and is connected through a yoke 32 to a slidable sleeve 33 to which are fastened a pair of connecting rods 34 which are connected by means of a pair of securing aperture means 35 to the collapsing plates 25. Operation of the cylinder 29 provides linear motion to the collapsing plates to effect the collapsing thereof when the plates are moved so that the mating surfaces of the wedges 26 and 27 enables the collapse and the expansion of the plates 25 when such plates are moved so that the inclined surfaces of the wedges 26 and 27 expand the plates. The collapsing and expansion of the mandrel is under the control of the hydraulic cylinder 29.

The butt ends 30 of the engaging wedge sides provide the shock that assists in the removing of the roll 20 when the plates 25 are moved by the rods 34.

Indexing of the mandrel to receive the leading edge of the sheet 24 is accomplished by a dog 44 and a pawl 45 under the control of a hydraulic cylinder 46 for one direction of operation or by dog 47 and pawl 48 under the control of hydraulic cylinder 49 for the other direction of operation. A detailed description of the indexing control is set forth later in this specification.

THE EJECTOR TROLLEY

Figure 2:
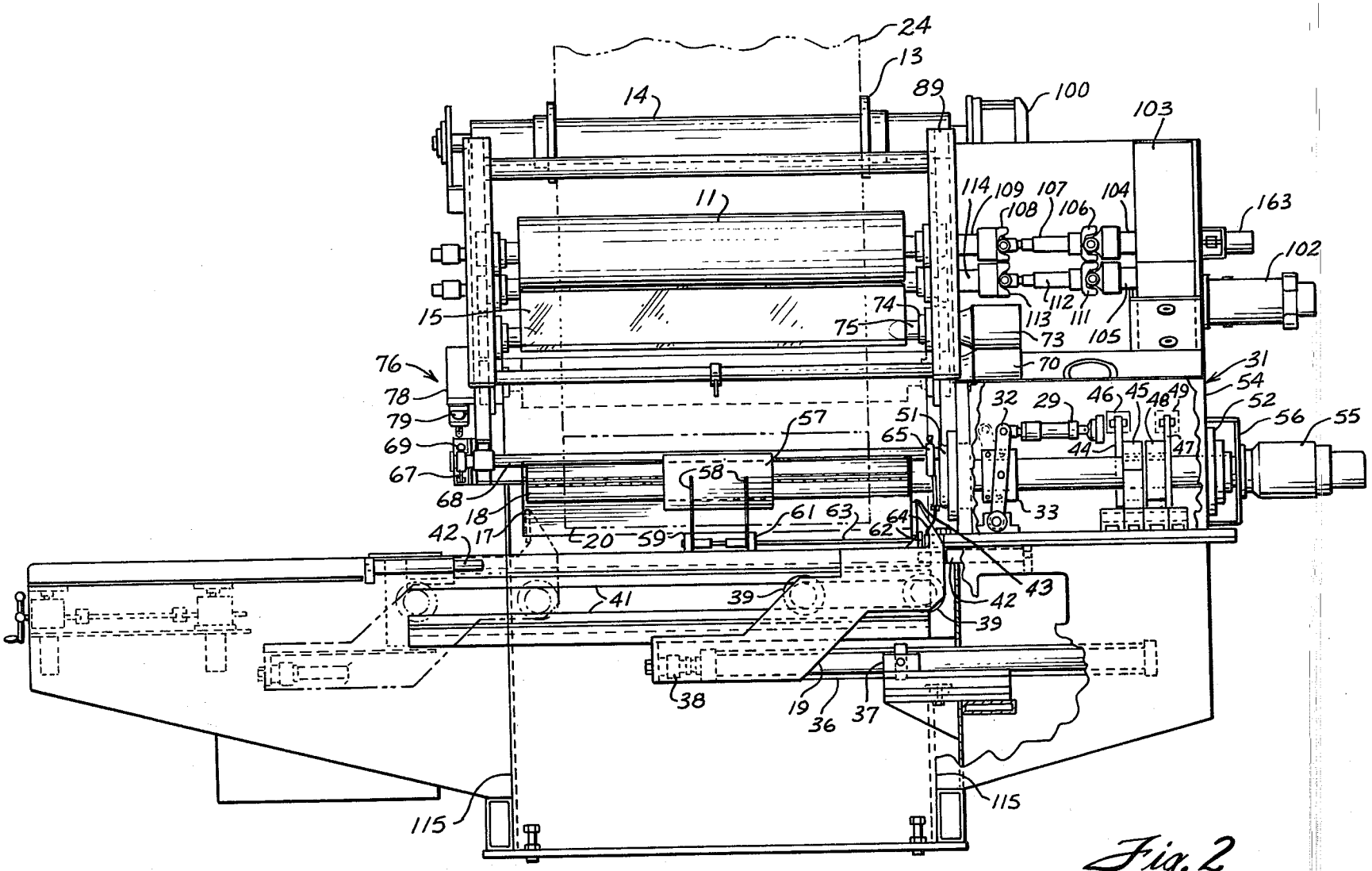
FIG. 2 is a view of the front of the complete winding machine as viewed in FIG. 1.

The ejector trolley 19, as shown in FIG. 2, is powered by an air cylinder 36 which is mounted on trunnions 37 and connected to the ejector trolley by a linear aligning coupling means 38 to prevent side loads from being applied to the air cylinder 36. The ejector trolley 19 is mounted on a pair of V-grooved wheels 39 which run in a set of restraining tracks 41 whereby trolley motion is restricted to the one dimension which is parallel to the axis of the mandrel 18. The velocity of the trolley is decelerated while approaching both its extended and its retracted positions by the employment of hydraulic shock absorber means 42. The shock absorbers 42 are mounted on a side of the trolley which is opposed to the side of the trolley to which the air cylinder 36 is mounted. This arrangement prevents axial forces from changing the straight path of the trolley motion at the points of deceleration. Connected to the trolley 19 is ejector pad 43 to actually contact the completed product roll 20 so as to effect the ejection.

Ejection of the finished product roll 20 is accomplished by the simultaneous activation of the air cylinder 36 and mandrel operating hydraulic cylinder 29. Movement of the roll 20 and the collapsing plates 25 is simultaneous in the same direction.

PRODUCT ROLL END RETAINER

In order to prevent the cut-off end of the product roll 20 from randomly flopping about as the product roll as the product roll is decelerating prior to being ejected, a curved retaining plate 57, or roller means if desired, is supported on connecting means 58 by two bearing means 59 and 61 spaced near one end of a torsion mounting means 63 and a bearing means 62 remote from said two bearings 59 and 61 near the other end of torsion means 63. Into the last said end of torsion means 63 is mounted a lever arm 64 which is connected to a hydraulic cylinder 65 to position curved retaining means 57. The curved means 57, during winding of the product, is positioned out of contact with the product. At the signal for the release of the knife 15, the curved means 57 is pulled inward to hold the outer convolution of the product roll to keep it from unwinding during the rapid deceleration of the mandrel. Simultaneous with the ejection of the roll, the curved means 57 is moved to clear the product roll 20.

FEED GUIDE

Figure 4:
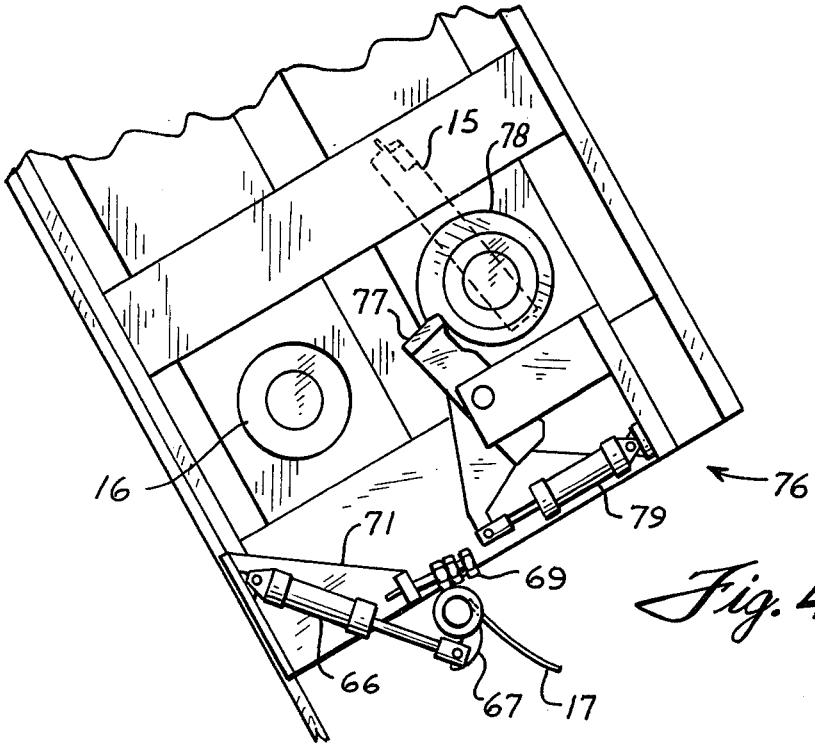
FIG. 4 is a view of a portion of the left side of the machine as viewed in FIG. 1.

A feed guide 17 guides the sheet 24 into the receiving slot 22 on the mandrel 18. Guide 17 is visible in FIGS. 3, and 4. The feed guide 17 is actuated by a hydraulic cylinder 66 mounted on the frame and acting on a lever 67 attached to the pivot means 68 for the feed guide 17. As shown in FIG. 4, adjustment to the proper position is accomplished with a jack screw 69 secured to pivot means 68 and acts on a stationary frame member 71 to enable the precise positioning of the feed guide 17. The feed guide 17 swings upward to align with the receiving slot 22 at the time that the mandrel 18 indexes and then swings out of the way when the mandrel is released to rotate. This release is provided by the dog and the pawl means 44 and 45 or 46 and 47, depending on the direction of turning. The feed guide is in the shape of an arc with the axis being perpendicular to the travel of the sheet 24. The reason for this is: if the sheet is bent in one direction, it is discouraged from bending in the other direction; the more the sheet is bent or wrinkled, the more times it will not align with a receiving slot in a mandrel. With the single bend of feed guide 17, the sheet readily aligns with receiving slot 22. There is also provided a stream of compressed air through nozzle 72 directed towards sheet 24 forcing it to conform to the curvature of the feed guide means 17 when winding a stiff product. This air stream is introduced on the feed signal when the new leading edge of the product starts moving towards the receiving slot and shuts off when the mandrel is released to wind the product, such release is by the dog and pawl means 44 and 45 or 46 and 47, again depending on the direction of the turning.

KNIFE AND ANVIL

Figure 10:
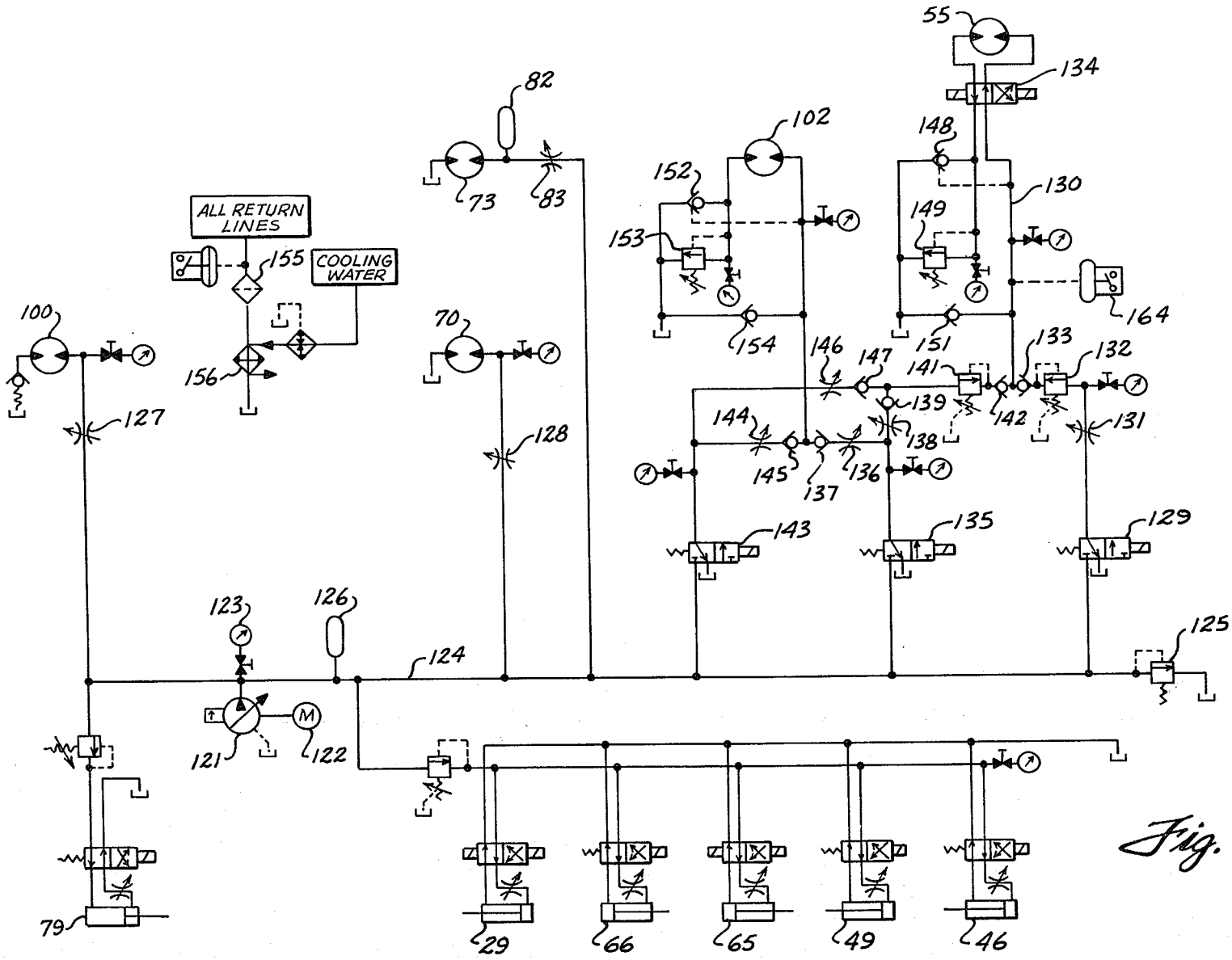
FIG. 10 is a schematic diagram of the hydraulic circuitry.
Figure 11:
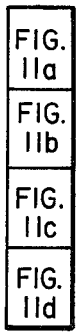
FIG. 11 is a showing of the relationship of FIGS. 11*a*, 11*b*, 11*c* and 11*d*.
Figure 11A:
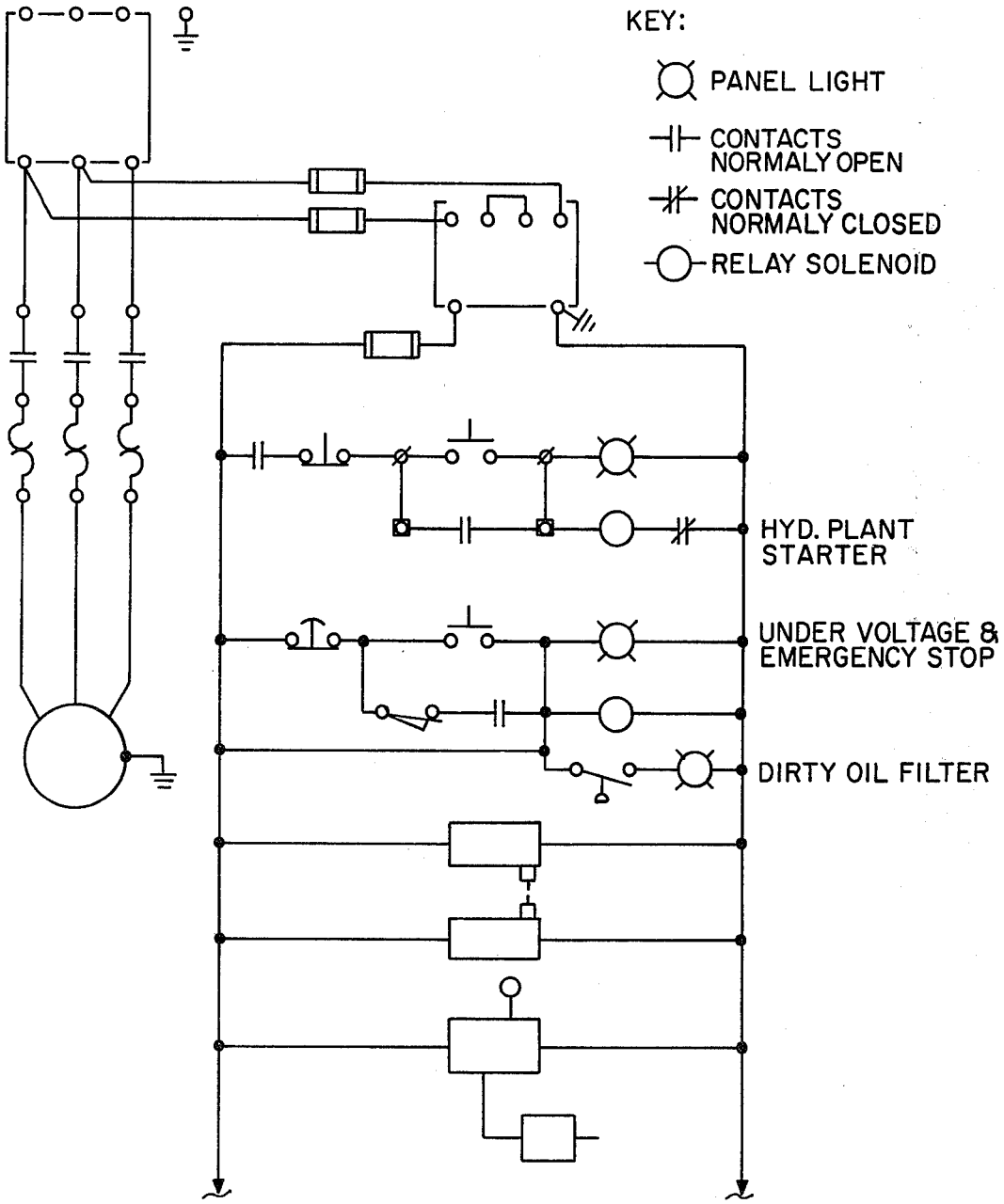
FIGS. 11*a*, 11*b*, 11*c* and 11*d* show in ladder form the electrical circuitry of the complete winding machine.
Figure 11B:
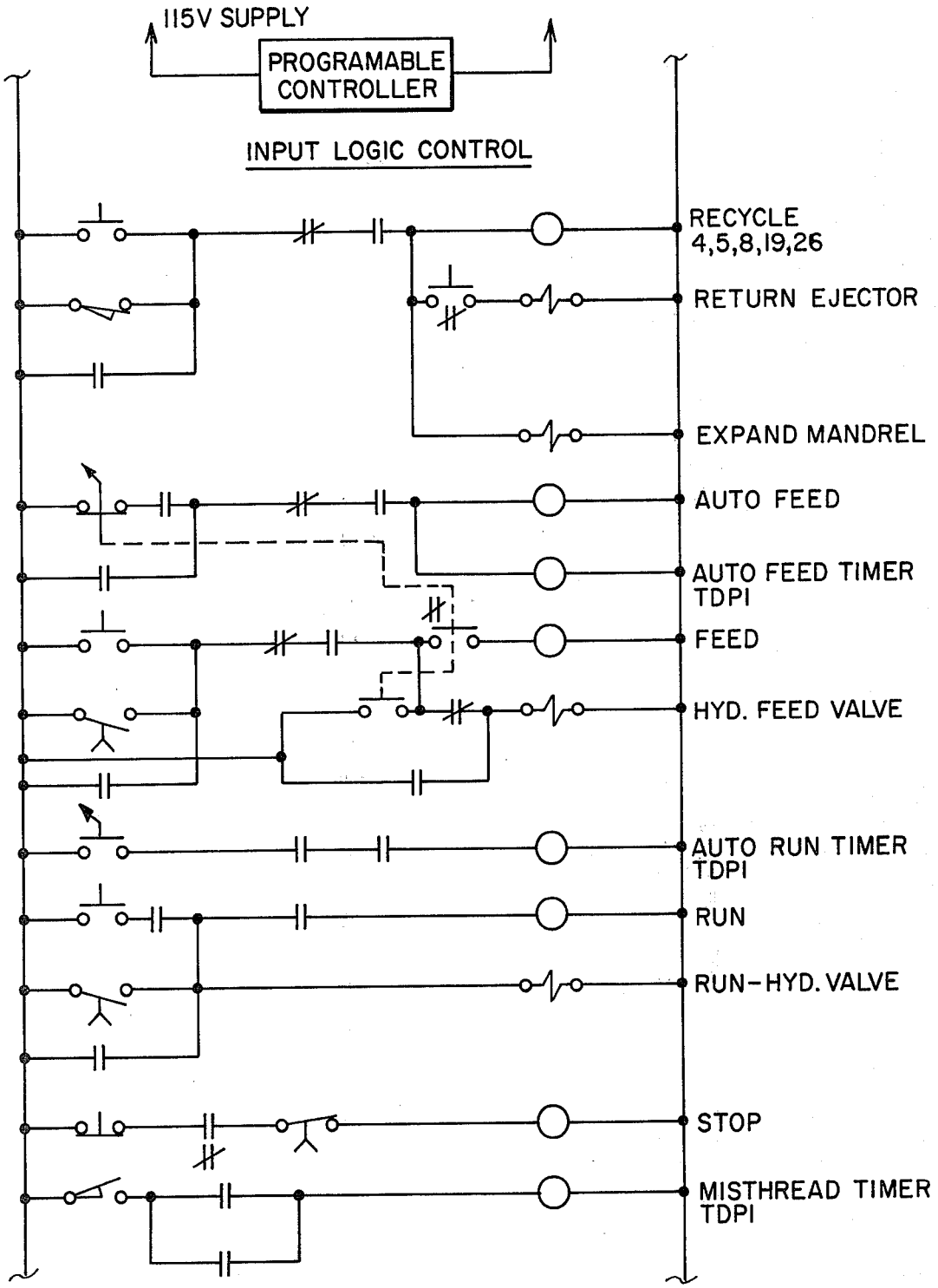
Figure 11C:
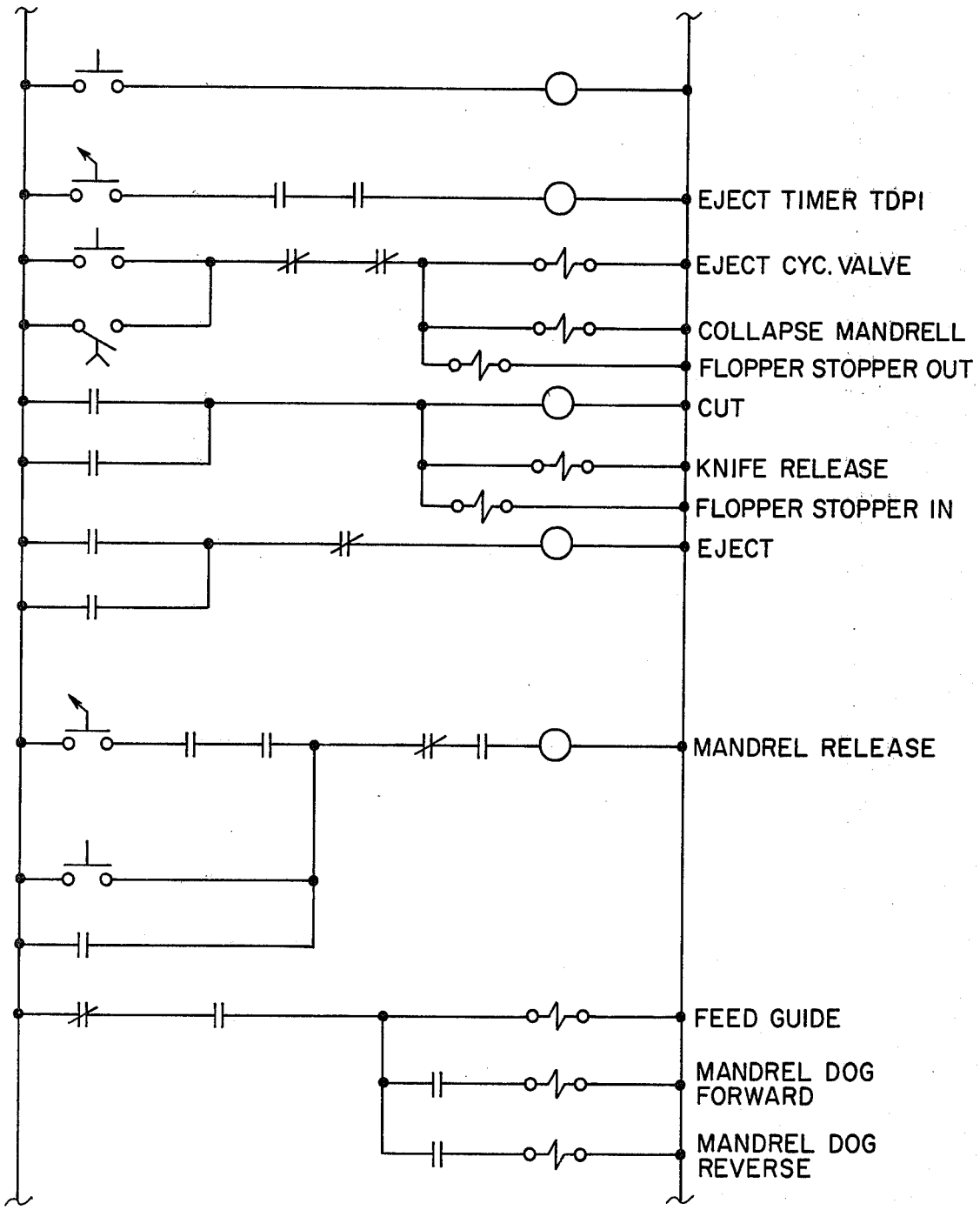
Figure 11D:
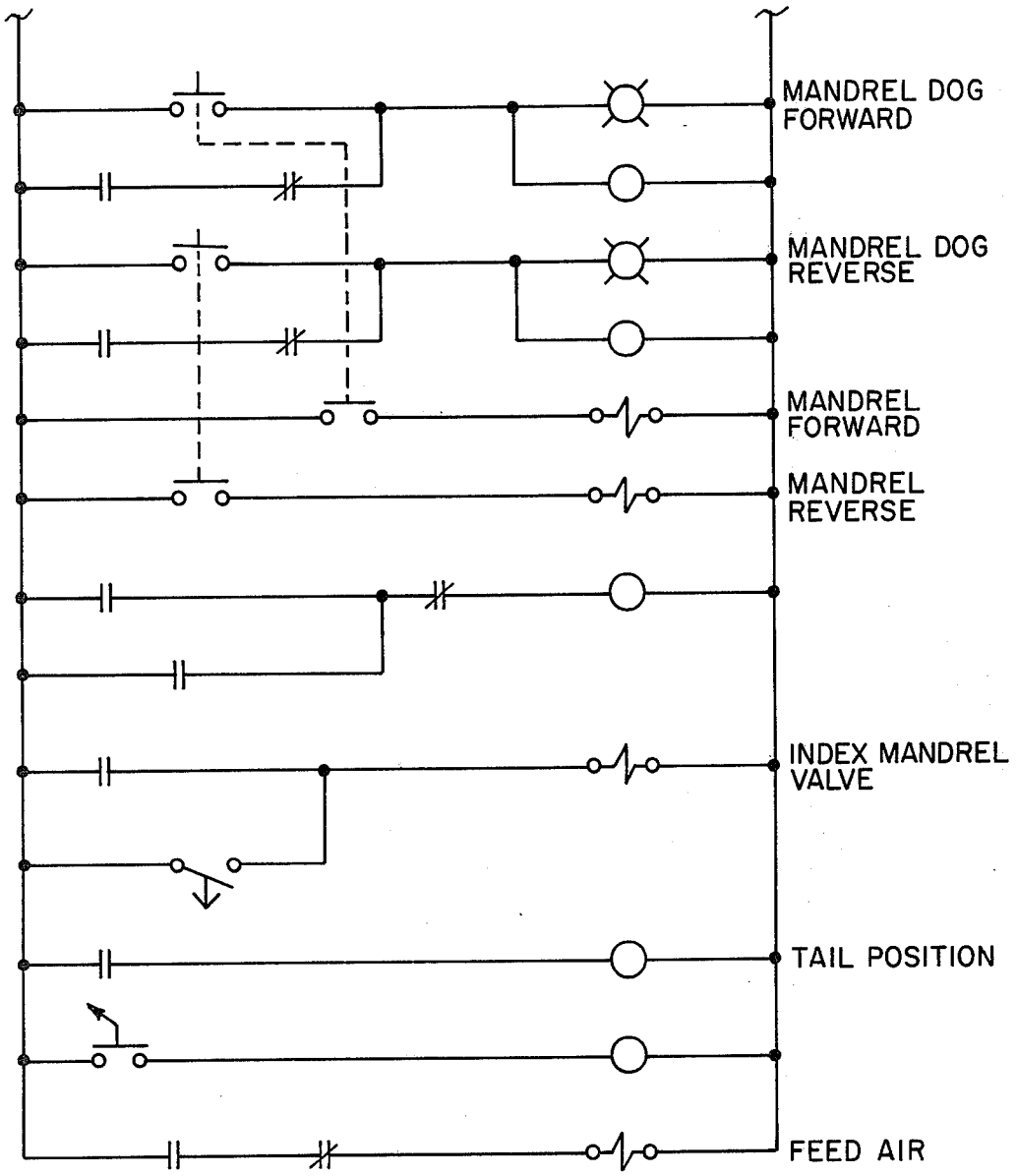

A cutting device made up of a rotary type knife 15 and an anvil roller 16 is positioned in the path of the travel of the sheet 24 just upstream from the feed guide 17. The knife 15 and anvil 16 are visible in FIGS. 2 and 3. The knife 15 rotates to make contact with the anvil roller 16 to effect severance of the sheet 24. The knife 15 is powered by hydraulic motor 73 and the anvil roller 16 is powered by hydraulic motor 70. The motors are connected by spline connection means, not shown, to the knife or anvil. A flange mounted bearing 74 is used to support the journals 75 of the knife. The anvil roller bearing is the same as the bearing for the knife. This bearing 74 is a back-to-back tapered roller type with no provision for self-alignment. Both sides of the bearing and motor mounting block are machined parallel with pilot holes machined concentric to assure alignment of the splines. This drive arrangement provides for a sealed enclosure to seal out dirt, sand, and other contaminants common to an asphalt roofing plant that prove destructive to most conventional drive systems such as chains, gears, belts and the like. The anvil roller 16 is fed through a needle valve 128 with a constant flow and is allowed to run at a comparatively slow speed at all times of operation. A restraining device 76, shown in FIG. 4, is mounted on the frame opposite the part of the frame on which the motor 73 is mounted. The restraining device 76 is connected to the knife 15 and includes dog 77 and a pawl 78 activated by a cylinder 79. Operation of the restraining device is described from the point that the dog is against the pawl to prevent rotation of the knife. Upon the receipt of a signal from a digital electronic counter 81 on the control panel, 161, shown in FIG. 12, the hydraulic cylinder 79 pulls the dog 77 away from the pawl 78 and the knife 15 rotates and cuts the sheet 24 on anvil 16. Anvil roller 16 is rotated by motor 70 at a speed in excess of the speed of the sheet 24 at the point of the cut. The knife continues to rotate under the influence of motor 73 until the pawl again rests on the dog. This position is such that the knife does not interfere with the winding operation. The knife motor is fed with a hydraulic circuit that includes an accumulator 82 as shown in FIG. 10 and a needle valve 83 set to a trickle flow. In the stalled condition resulting from the operation of the restraining device 76, the potential energy stored in the accumulator 82 enables the knife to operate with a very positive cutting force. The accumulator 82 is sized to run out of fluid between one half and three fourths of the rotation of the knife, permitting the knife motor 73 to decelerate to the speed controlled by the needle valve 83. This enables the knife to return to the set point on the pawl slowly and gently. Upon the engagement of the dog and pawl, the motor again stalls and the trickle flow through the needle valve permits the pressure to build again in the accumulator to be ready for the next cut cycle. When knives are driven by torque limiting devices, as in previous devices, a large amount of energy is wasted and when knives are reset at driving force levels, noise and shock problems exist. These problems have been alleviated by this knife operation. Further, this arrangement provides for accurate and consistent cutting of the predetermined length of the product since the hydraulic accumulator 83 provides repeatedly consistent operation. Other devices such as friction devices have inconsistent operation because of inherent thermal variations which result in frictional variations.

Figure 3:
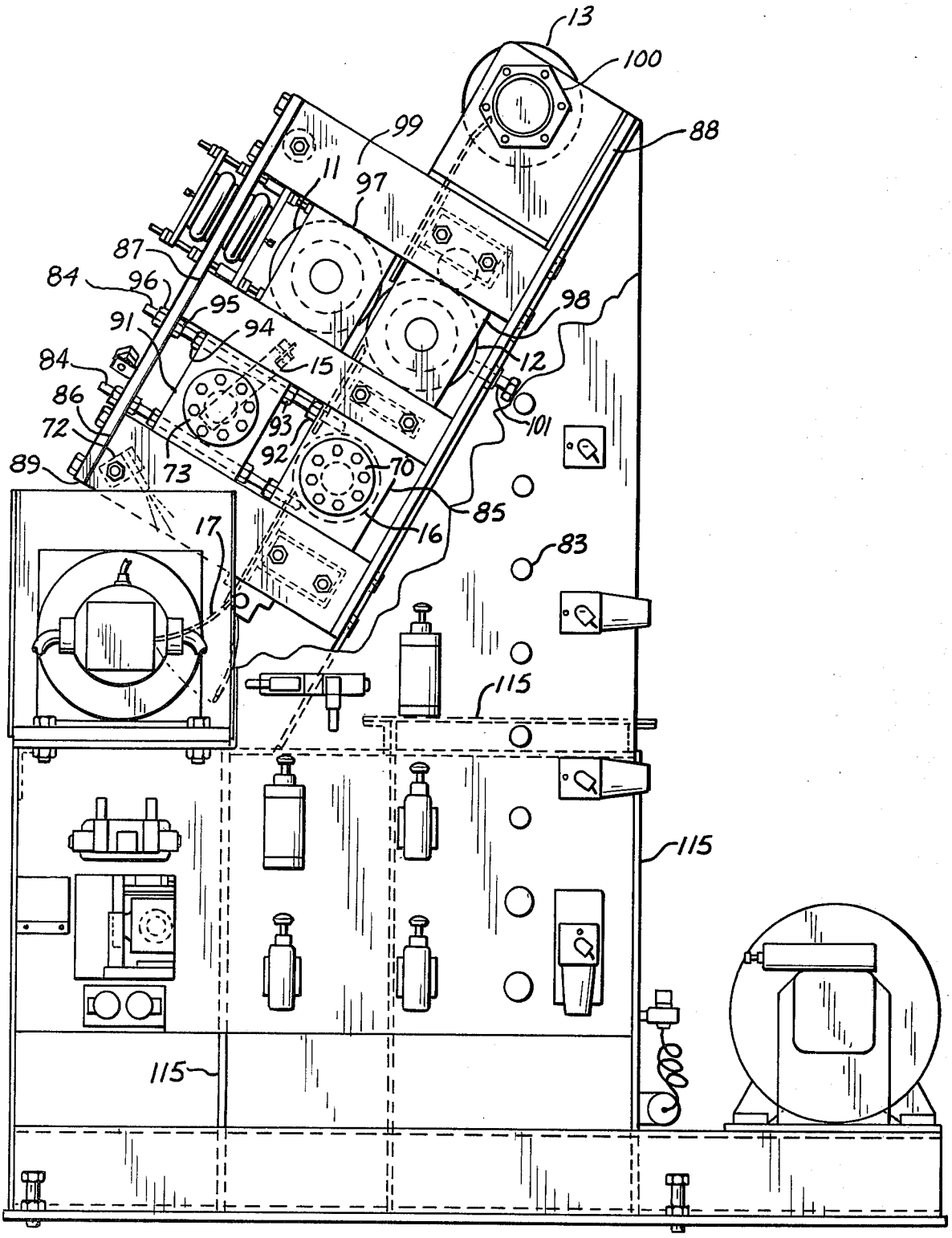
FIG. 3 is a view of the right side of the complete winding machine as viewed in FIG. 1.

The anvil roller and the knife, as shown in FIG. 3, are mounted on the frame of the machine and are adjustable relative to each other by the combination of threaded rods 84 and blocks which support bearings at each end of said anvil roller and knife, and retained between parallel block means. Bearing pads, not shown, made of sound deadening material are inserted between the bearing support block and the two parallel blocks which confine it. For example, the block 85 which contains the bearing means for anvil roller 16 and has motor 70 mounted thereon with blocks 86 and 87 confining anvil mounting block 85 therebetween. The pads are between blocks 85 and 86 and between blocks 85 and 87. A knife mounting block 91 contains the bearing means for the knife and has the knife motor 73 mounted thereon. The frame member 89 is a beam for front support of the upper assembly.

Adjustment of the relationship of the knife to the anvil roller is accomplished by the nuts on the threaded rods 84. The rods are threaded into the anvil block 85 with a nut 92 securing the position of the rod therein. Nuts 93 and 94 are on opposite sides of the knife block 91 to locate the knife with respect to the anvil roller. Nuts 95 and 96 on opposed sides of frame 89 position the rods with respect to the frame 89. The two other blocks supporting the anvil and the knife along with their threaded rods and nuts complete the structure necessary for precise adjustment of the cutting operation.

PULL ROLLERS

A pair of pull rollers 11 and 12 is provided to pull the input product from the source in such a manner that the varying tension required to move the product over the operating distance does not cause a variation in the adjusted winding tension of the product wound roll. Also, during the winding operation, the product sheet does not come into contact with any structure between such pair of pull rollers and the product wound roll on the mandrel. Unnecessary wear is eliminated. These rollers are shown in FIGS. 2 and 3.

The pull rollers 11 and 12 are mounted in a manner similar to the mounting of the knife 15 and the anvil roller 16 in that the mounting blocks 97 and 98 in which the pull roller bearings are mounted are sandwiched between one side of the separator means 87 and mounting means 99. Between the separator 87 and blocks 97 and 98 and between blocks 97 and 98 and mounting means 99 are bearing pads made of sound deadening material. The lower roller block 98 is adjustable by locking jack screws 101 secured in frame member 88. The other roller block 97 is mounted so as to be separated from the lower roller so that the sheet can be threaded between such pull rollers and also mounted so as to provide clamping force against the sheet and the lower roller. The motion that results in spreading and clamping is accomplished by rubber pillow type pneumatic actuating devices with one at each end of the roller 11 to raise the roller and another one at each end of the said roller 11 to clamp the sheet against roller 12. The loading forces applied on either end are controlled by air pressure regulators (not shown) mounted in the pneumatic line feeding the clamping device. This permits minute adjustment for the clamping pressure throughout the width of the sheet 24.

The pull rollers 11 and 12 are driven by a hydraulic motor 102 through a sealed helical gear box 103 which has two output shafts 104 and 105 which rotate in opposite directions. Shaft 104 is connected to a first universal joint 106, a drive shaft 107, a second universal joint 108 to the journal 109 of roller 11. Shaft 105 is connected to a third universal joint 111, a second drive shaft 112, a fourth universal joint 113 to the journal 114 of roller 12. Alternately, hydraulic motors can be connected directly to the journals of the rollers.

Prior pull roller driving means include open spur gears which run out of mesh and which are exposed to contaminants present in the process, i.e., sand, to cause excessive wear. Further, operation of spur gears is limited in pitch line speed to one thousand feet per minute. The above-described pull roller driving mechanism eliminates the problems of spur gears and permits speeds of up to two thousand feet per minute.

A guide roller 14 is provided with limiting flanges 13 to direct the input sheet 24 into the pull rollers 11 and 12. A guide roller motor 100 is mounted to support one end of the guide roller 14 and turn just fast enough to evenly distribute the wear thereon. Normally, the input sheet has come from a distant roll of manufactured product and such guide roller is to keep the sheet in alignment with the pull rollers and the mandrel. Guide roller 14 is shown at the top of FIG. 2.

As for the framing of the machine, it is to be noted that a central portion which is just wider than the rollers and winding part of the mandrel forms the main frame from which all of the elements outside thereof are suspended. Care has been taken to have the lower portions of the outside elements sufficiently high above the floor that housekeeping can be reduced to a minimum and be easy to maintain. Further, the reservoir 115 as indicated in FIG. 2 for the hydraulic fluid is mounted within the frame at the base thereof with the fortunate result of dampening vibrations within the machine. Also, the product handling assembly which included the pull rollers 11 and 12 and the other structure mounted on base frame 88 is shown inclined at an angle, sixty degrees, for example, in order to accommodate the receipt of the sheet 24 from supply rolls stored over the machine. This reduces the distortion of the sheet to a minimum. However, in other applications where the supply sheet arrives from a horizontal location, the assembly could well be oriented in a horizontal plane.

THE HYDRAULIC CIRCUIT

Turning now to FIG. 10 in which the hydraulic circuit is shown schematically, a pressure compensated hydraulic pump 121 is operated by electric motor 122 to be the hydraulic power source for the system. A pressure gauge 123 is available to read the pressure on the pump output line 124. Pump output line 124 is protected from pressure overload by a system relief valve 125 and an accumulator 126.

From pump output line 124, there is a first needle valve 127 which meters the fluid flow to the guide roll motor 100. Also connected directly to the output of the pump output line 124 are all of the hydraulic cylinder circuits which are fed through pressure reducing valves. This includes knife restraining cylinder 79, mandrel collapse cylinder 29, feed guide cylinder 66, retaining means cylinder 65, mandrel indexing cylinders 49 and 46. Constant flow passes from pump output line 124 through a second needle valve 128 to the anvil roller motor 70 continuously as stated previously.

All of the following circuits obtain their fluid flow directly from the pump main manifold 124. As previously stated, the knife motor is driven by a fluid flow through a third needle valve 83 which fills an accumulator 82 to give the knife motor 73 a surge of power and then a dampening so as to slowly approach the stalled motor state.

A mandrel indexing solenoid valve 129 opens the fluid power source to move the mandrel motor 55 without moving the pull roller drive 102. This is accomplished by fluid passing through a fourth needle valve 131 which reduces the flow to cut the speed of the mandrel whereas flow then passes through pressure reducing valve 132 to cut the force on the mandrel to the extent that the pawl 45 or 48 engages its corresponding indexing dog. The flow then passes in a pressure line 130 through a check valve 133 to prevent backflow, on its way through a solenoid operated directional valve 134 to select a direction of rotation of the mandrel. Products may thereby wound in either direction. The flow then passes in pressure line 130 to the mandrel motor 55 to rotate the mandrel to the index position.

For the feed condition, fluid flow from the flow line 124 passes upon the opening of the feed solenoid valve 135 to a needle valve 136, which controls the pull roller motor speed for the feed check valve 137 and on to pull roller motor 102. Also, from the solenoid valve 135 through needle valve 138 which controls the initial winding speed of the mandrel, check valve 139, an adjustable pressure reducing valve 141 which controls the winding tension on the sheet, through a check valve 142, into pressure line 130 and through directional valve 134 to mandrel motor 55.

For the run condition, operation of run solenoid valve 143 opens to allow flow through a needle valve 144, wherein the control of the speed of the pull roller motor 102 is accomplished through a check valve 145 to pull roller motor 102. Flow also passes from run solenoid valve 143 through a needle valve 146 which is set to control the runaway speed of the mandrel motor 55 during times when the sheet 24 is not present to restrain the rotation of the mandrel 18. From the needle valve 146, the flow passes through check valve 147, pressure reducing valve 141, check valve 142, through pressure line 130 and directional control valve 134 to the mandrel motor 55. During the run operation, fluid flow passing through mandrel motor 55 goes through a passage in directional valve 134 that is different from the passage utilized during the flow towards the motor 55, goes backwards through a pilot operated check valve 148 which is held open for such reverse flow by a pilot pressure connected from pressure line 130 driving mandrel motor 55, then goes back to the reservoir 115. When motor 55 is stopped by the closing of the solenoid valves 129, 135, and 143, no pressure is present in the pressure line 130 and the pilot pressure derived therefrom drops enough to allow the pilot operated valve 148 to close. That is, to change its operation to prevent reverse flow. This results in pressure building up in the discharge line of the mandrel motor 55 to the level needed to relieve over a relief valve 149 to the reservoir 115. This provides a braking action on the motor 55. The torque level of the braking force is directly related to the pressure setting on the relief valve 149. A check valve 151 has been installed to prevent the pressure on the input line from dropping to a negative point that would induce cavitation of the motor. Valve 151 is installed from the output of relief valve 149 back through the pressure line 130 feeding the motor 55. The pull motor braking circuit is identical with the mandrel motor circuit with pilot operated check valve 152 being exactly like pilot operated check valve 148, relief valve 153 being exactly like relief valve 149, check valve 154 being the equivalent to check valve 151.

All return lines from all operating devices return to the reservoir 115 through a conventional filter means 155 and a thermostatic controlled water cooled heat exchanger 156 to maintain constant temperature and viscosity in order to assure precisely consistent repetition of winding the product rolls.

Pressure gauges can be installed at various places to make trouble shooting easier.

CONTROL OF THE MACHINE

Figure 12:
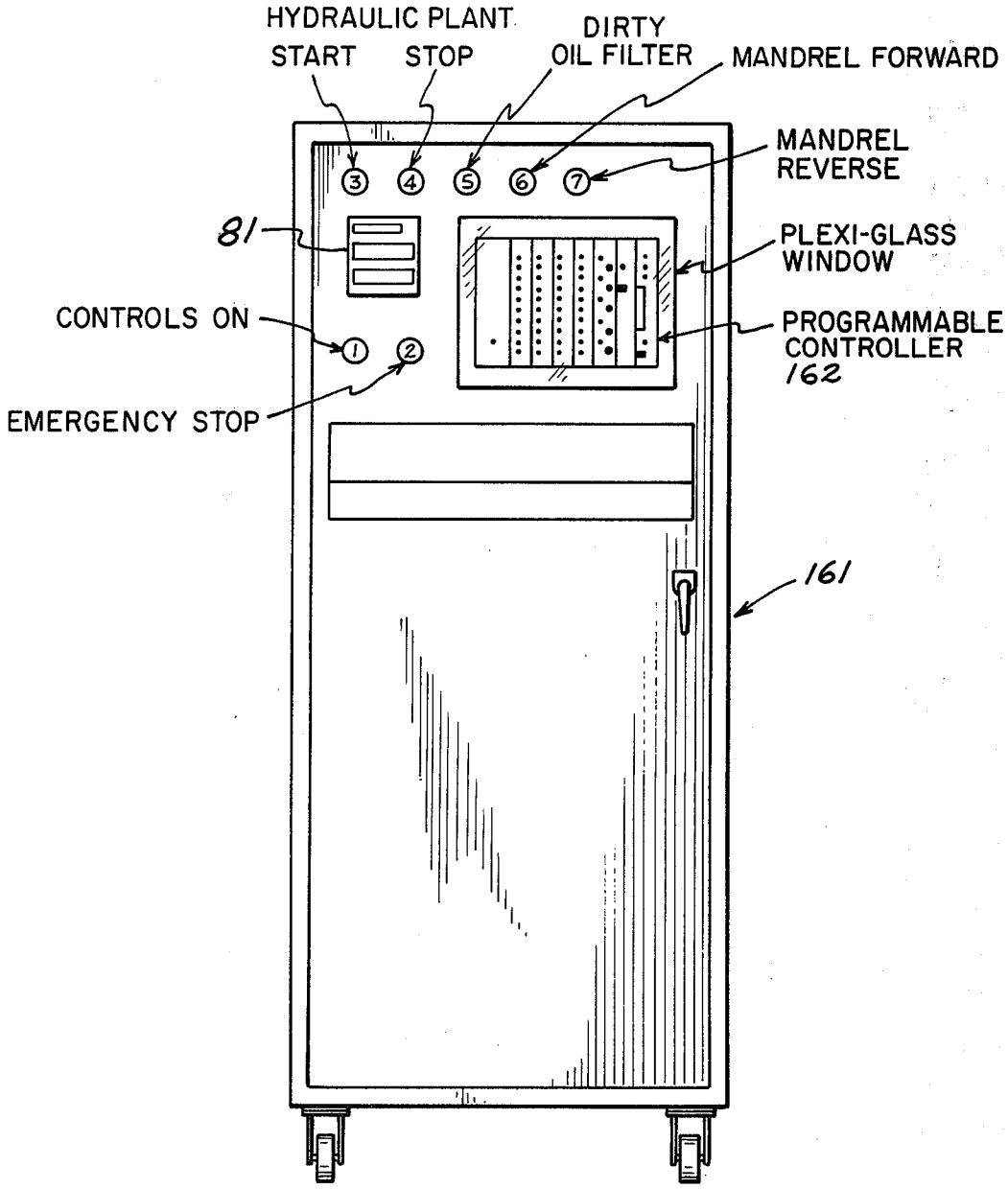
FIG. 12 is a view of the control panel.

An electrical panel means as shown in console 161 in FIG. 12 is the communication means between the operator and the machine. A flexible cable connection (not shown) and the wheels on the base of the console enable movement of the console to any of several desired positions. For example, since the full time attention of the operator is not required for the operation of the winder machine, the console can be moved into a position whereby the operator can also wrap the finished product rolls ejected from the mandrel. Also, there is a capability of the control of the stage of the process that preceeds the winder machine to be included in the console 161 whereby the operator has ready access to the control of the source of sheet 24.

A series of logic steps shown in FIGS. 11A, 11B, 11C, and 11D, control the automatic operation of the machine and such series is employed in a programmable controller 162 mounted in the control console 161. The inputs to the controller are from push buttons, selector switches on the console (not shown) and feedback signals from sensing devices mounted on the machine. The outputs from the controller 162 are applied selectively to the solenoid valves to effect the operation of the machine.

OPERATING PROCEDURES

The operating steps experienced by the machine will now be described. The first significant operating condition is termed the ready condition wherein the mandrel has been indexed to the feed position, the ejector trolley 19 has been retracted, and a new leading edge on sheet 24 has been cut. The second significant operating condition is the feed condition during which time the pull rollers 11 and 12 feed the new leading edge of sheet 24 to the receiving slot 22 of mandrel 18, mandrel 18 is released from the indexing means to be free to rotate, and, under control of the pull roller feed needle valve 136, begins to wind the product roll 20 at a reduced rate of speed preparing for the run condition. Thirdly, in the run condition, sheet 24 is wound into the product roll 20 at a high rate of speed determined by the setting of the pull roll run needle valve 144. An alternate control of the run condition could be to utilize the speed of the incoming sheet 24 from the source to regulate the winding speed. Upon receipt of a signal from a counter that the proper length of material has been wound, the braking or stopping condition occurs. The pulling roller drive motor 102 and the mandrel drive motor decelerate to a halt, the sheet 24 is cut, and the product roll 20 is ejected from the mandrel 18 by the ejector trolley 19.

SYSTEM OPERATION

After the controls are energized, the hydraulic pump activated, the selection of the direction of the rotation of the mandrel, the first step is to raise pull roller 11 so that the sheet 24 from the supply source can be pulled over the guide roller, shown at the top of FIG. 2, between the pull rollers 11 and 12, between knife 15 and anvil onto guide means 17. Pull roller 11 is closed onto the sheet towards roller 12 when the sheet 24 is aligned so as to pass freely through the machine without binding or being folded. A manual control means permits the enabling of the knife to cut the sheet so as to present a clean, straight leading edge thereon. Thereafter, the knife is activated automatically upon the receipt of a signal from the counter that the predetermined length of rolled sheet has been accomplished. A recycle control means causes the mandrel to index to the feed position by opening the valve 127 to the mandrel motor 55 and activating cylinder 46 or 49, depending upon the previously selected direction of winding; cylinder 29 to expand collapsing plates 25 which are on mandrel 18; and the ejector trolley 19 to return to the ready position.

The feed condition can be initiated, in the automatic mode, by a signal responsive to the completion of the mandrel indexing. A manual feed control is provided for occasions when manual operation is desired.

When the leading edge of the sheet 24 reaches the receiving slot 22 of the mandrel 18, a photoelectric sensing device, directed to detect such arrival at the receiving slot 22, provides an output signal which, following the arrival of the leading edge of the sheet within the slot 22 a distance sufficient to properly hold such edge, activates the release of the mandrel by the operation of cylinder 46 or 49 depending upon the preselected direction of turn of the mandrel, enables the turning to the mandrel at a velocity for feeding in order to secure the sheet 24 to the mandrel and simultaneously cause the feed guide 17 to retract and clear the product roll area around the mandrel. The winding of the product roll 20 is thereby initiated. Manual mandrel release controls are also provided. It is to be noted that only the pull rollers and the mandrel are in contact with the sheet. There are not idlers nor additional mechanisms that come in contact with the sheet during the winding operation.

The run condition is initiated by a signal pulse that is activated following a delay that assures that the photoelectric sensing device does not detect a discontinuity of the sheet and that the proper tension is on the sheet, whereby revealing that the mandrel is properly loaded with the sheet, ready to wind. A run manual control is provided as are all functions provided with manual back-up controls. The run initiating signal activates the opening of run valve 143 and the closing of feed valve 135.

In order to determine proper tension on the sheet as referred to above, a pressure sensing switch 164 is connected to the pressure line 130. In the absence of a sheet 24 secured on the mandrel and extending to pull rollers 11 and 12 whereby proper winding tensioning is established, the pressure needed to rotate the mandrel will drop to a level commensurate with the load thereon. The pressure setting for the pressure sensing switch 164 is set just below the pressure required to wind the most loosely wound product roll 20 produced by this machine so that lower pressures occur only when the sheet is absent. Any pressure below such preset pressure produces a pulse from switch 164 to the programmable controller that the mandrel is not winding, but turning freely without the sheet being loaded thereon. The programmable controller, following a delay to accommodate for false signals, produce a stop condition routine that brings the pull roller and the mandrel drives to a halt.

The machine remains in run condition until the desired length of the sheet 24 has been wound on the mandrel. The length measurement of the wound sheet is provided by the machining of the pull roller 11 to have a precise measured circumference. Mounted on pull roller gearbox 103 is an encoding means 163 which is operatively locked to roller 11 to produce a specific number of output pulses in response to each rotation of roller 11. These pulses are applied as an input to the counter 81. Upon the receipt of a preset number of input pulses which are representative of the exact length of the sheet that has passed through pull rollers 11 and 12, the counter 81 produces an output signal that the braking or stopping condition take place.

It is to be noted that the pull roller 11 is machined to a precise circumference of twenty five inches and, with the encoder 163 producing a hundred output signals per revolution of roller 11, each output pulse represents one fourth of an inch of sheet 24. With such accurate measurement, wasteful trial-and-error measuring done in the prior art is eliminated. Further, there is a need to occasionally add a length of sheet 24 to a roll, such as to replace the usable sheet lost by the presence of a splice at the end of one supply roll to the beginning of the next supply roll. This replacement length is provided by a manual control which, when operated, grounds the output pulses from the encoder 163 to prevent the counter from receiving pulses for the time that the waste sheet is passing through the pull rollers. Release of the last said manual control again applies the pulses to the counter and the measurement continues with a proper accommodation for a waste section.

So it is seen that I have provided a machine for winding rolls of roofing sheet material which operates with minimum waste of the sheet, which operates with minimum damage to the material, which produces precisely measured lengths of the sheet on the rolls, which operates at minimized noise levels, which operates in cooperative alignment with the supply source, which utilizes the collapsing operation of the mandrel to assist in the ejection of the wound roll, which utilizes an accumulator in the knife drive hydraulic circuit to produce a pulse for rapid cut and then provide the knife reset at low pressure with a trickle flow then refilling the accumulator to build up pressure for the next cutting cycle, which utilizes aligning means for the ejector which remove any binding forces thereon, which has the oil reservoir in the middle of the base to absorb and dampen vibrations, which utilizes inclined surfaces of wedges under the collapsing plates to determine the position of such plates and uses the engagement of butt ends of wedges to give an added shock in removing the finished roll from the mandrel, and which includes an automatic shutdown circuit for safety purposes and for operation to complete the winding operation cycles.

It is readily seen that trouble shooting and repair functions are easily accomplished by the use of hydraulic power and control with electrical means pin pointing places of trouble. There is no necessity of bringing in an expert from another location as is required with complex electronic systems since the repairs for operation can be performed by trained local workers. Also, the feed through mandrel of the prior art has been eliminated and the waste sheet associated with threading the prior mandrels is not present in the instant invention. Hand feeding of the sheet into the mandrel has been eliminated. Further, the tension on the wound roll is controlled without constant adjustment with this hydraulic system. The simplicity of the contact of the sheet with the machine combined with the cushioning effects of the hydraulic drive and speed controls permit this machine to operate at speeds up to twice that of the prior art. In the prior art, there are open faced gears which have to operate out-of-mesh in their normal routines resulting from different thicknesses of material, or from different adjustments that result in this out-of-mesh condition, to substantially shorten the useful life of such gears. Also, much of the operation is faster than that recommended for such gears. Further, no chain drives are used in this invention. The hydraulic power transfer medium of this invention extends the machine's life considerably.

Another contribution of this invention is that the control panel is made so that it is available to an operator to be able to accomplish additional tasks while operating the winding machine. With the winder operating automatically, the operator is available to wrap the finished wound product roll as well as oversee the winder operation.

With the mandrel mounted without an outboard bearing, that is one that would be mounted at the discharge end of the mandrel in the direction of the ejection operation, the operating time is greatly reduced since such bearing would normally be required to swing out of the way in order to remove the rolled product. Obviously such a step would greatly slow down the production capabilities of the machine.

Although the invention has been particularly described and shown relative to the foregoing embodiments, it will be understood by those having normal skill in the art that various other changes, additions and modifications may be made without departing from the spirit of this invention.

What is claimed is:

1. In a machine for winding sheet material into a product roll:

a guide roller means, a pair of pull roller means, a sheet severing means including a knife and an anvil to cut said sheet to produce a back end and a front end thereof, a sheet guide means, a mandrel means with a sheet securing slot means incorporated therein and a pair of collapsible plates mounted thereon, whereby rotation of said mandrel will form said sheet into a product roll, said sheet guide means directing the front end edge cut by said knife into said slot means on said mandrel, means for retaining the back end edge cut by the knife against said product roll following the cut by the knife during deceleration of the mandrel for the removal of the product roll, and means for ejecting said product roll from said mandrel;

the alignment of the aforesaid means being such that the sheet material is maintained with the supply source of such sheet material so as to provide minimum bending of and minimum contact with said sheet material on its way to the mandrel.

2. In an ejector means for ejecting a roll of wound sheet material from a sheet winding machine:

an ejector pad means for engaging said roll during ejection thereof, a trolley means having a pair of motion limiting wheels thereon, a pair of opposed rails mounted on said sheet winding machine, a trolley means having a pair of wheels mounted thereon, said wheels confined by said rails so that the motion of the trolley is limited to the one dimension defined by the confinement of said rails, an ejector pad mounted on a rearward end of said trolley above said wheels, said ejector pad providing the ejection force on said roll of wound sheet material, a hydraulic power means mounted on said sheet winding machine, means for connecting said power means to said trolley means on a forward end of said trolley below said wheels, alignment means for said power connecting means whereby said trolley operates without any binding forces thereon.

3. In a means for retaining the loose end of a roll of sheet material wound on a sheet winding machine:

means for engaging the wound roll to maintain the tension thereof after the sheet material thereof has been separated from the supply of sheet material, means for mounting said means for engaging in proper position on said sheet winding machine, means for changing the position of said means for engaging in response to control signals applied thereto, and torsion means connecting said means for engaging to said means for changing.

4. In a winding machine for producing rolls of sheet material:

means for pulling said sheet material from a supply source, means for measuring the precise length desired, means for cutting said sheet to predetermined lengths, means for winding said sheet into a roll, means for ejecting said roll when completed, means for resetting said sheet in said means for winding, and hydraulic power means for operating said means for pulling, said means for cutting, said means for winding, and said means for ejecting.

5. In a winding machine for producing rolls of sheet material:

a mandrel means for winding said rolls, a hydraulic motor means connected to said mandrel for operation thereof, a pair of pull roller means for supplying the sheet to said mandrel means, a pair of hydraulic motor means connected one to each of said pull roller means, a knife and anvil means for severing said sheet means at proper lengths, a pair of hydraulic motors means connected one to each of said knife and anvil means, an ejector means for removing the finished rolls from said mandrel, a hydraulic motor connected to said ejector means, a hydraulic power source means, means for connecting said power source means to each of said hydraulic motors.

6. In a cutting means for a roll winding machine, a knife means having an axle means extending longitudinally therefrom through a bearing means at each end thereof, said bearing means mounted on said winding machine, a hydraulic motor mounted on said winding machine and connected to one end of said axle means, a positioning device for said knife means having a pawl means secured to the other end of said axle means and a dog means mounted on said winding machine to engage said pawl and arrest the rotation of said knife, and a hydraulic cylinder connected at one end to said winding machine and at its other end to said dog to pull the dog means away from said pawl means to permit the hydraulic motor to rotate the knife means in the cutting of the roll material.

7. In the control means for a sheet roll winding machine:

a pair of pull roller means, one of said pull rollers being precisely circumferentially dimensioned, means for counting the rotation of said one pull roller, means for emitting a control signal when a particular counting of rotation represents a predetermined length of sheet material pulled through said roller means, a knife and anvil means having operating means, means for applying said control signal to said operating means to initiate the cutting of the sheet material by said knife and anvil.

8. In the control means of claim 7:

means for disabling said means for counting so as to provide additional sheet material to compensate for losses in such sheet material resulting from the joining of ends of the source of such sheet material being pulled through said pull roller means.

9. In a control means for a sheet material roll winding machine:

means for sensing the completion of the operating stages, means for positioning a mandrel winding means for the engagement thereon of said sheet material, means for accelerating said mandrel to wind said sheet, means for determining the amount of sheet material to be wound, means for cutting said sheet material upon the completion of said winding, means for ejecting said completed sheet material roll, and means to reset all of said means for a repetition of the operating cycle.

* * * * *